US006868857B2

(12) United States Patent
McCasker

(10) Patent No.: US 6,868,857 B2
(45) Date of Patent: Mar. 22, 2005

(54) ROTARY CLEANING APPARATUS

(76) Inventor: Douglas Brett McCasker, P.O. Box 2536, Jupiter, FL (US) 33468

( * ) Notice: Subject to any disclaimer, the term of this patent is extended or adjusted under 35 U.S.C. 154(b) by 171 days.

(21) Appl. No.: 10/077,252

(22) Filed: Feb. 14, 2002

(65) Prior Publication Data

US 2002/0144714 A1 Oct. 10, 2002

Related U.S. Application Data

(60) Provisional application No. 60/281,540, filed on Apr. 4, 2001.

(51) Int. Cl.[7] ..... B06B 9/02

(52) U.S. Cl. ..... 134/56 R; 134/167 R; 134/168 R; 134/169 R

(58) Field of Search ..... 134/56 R, 166 R, 134/167 R, 168 R, 169 R, 172, 176, 179

(56) References Cited

U.S. PATENT DOCUMENTS

| | | | | | |
|---|---|---|---|---|---|
| 1,382,633 | A | * | 6/1921 | De vito | 422/269 |
| 1,857,766 | A | * | 5/1932 | Peterson | 239/249 |
| 2,005,180 | A | * | 6/1935 | Cronin | 239/750 |
| 3,565,342 | A | * | 2/1971 | Orem et al. | 239/227 |
| 3,825,022 | A | * | 7/1974 | Metz | 134/104.1 |
| 3,985,572 | A | * | 10/1976 | Petermann et al. | 134/34 |
| 4,078,727 | A | * | 3/1978 | Lingnau | 239/247 |
| 4,246,041 | A | * | 1/1981 | Lillo | 134/23 |
| 4,311,556 | A | * | 1/1982 | Iwamoto et al. | 376/249 |
| 4,341,232 | A | * | 7/1982 | Maton | 134/107 |

FOREIGN PATENT DOCUMENTS

| | | | |
|---|---|---|---|
| AU | 655111 | | 5/1993 |
| JP | 59-27299 | * | 2/1984 |
| JP | 62-18006 | * | 8/1987 |
| JP | 6-134427 | * | 5/1994 |
| JP | 9-239337 | * | 9/1997 |

* cited by examiner

*Primary Examiner*—Frankie L. Stinson
(74) *Attorney, Agent, or Firm*—McHale & Slavin

(57) ABSTRACT

Disclosed is an apparatus and method for cleaning the interior of a container. The cleaning apparatus includes a support frame mounted to a rotor assembly having at least one spray arm, at least one jet spray nozzle located on the spray arm, and at least one atomizing spray nozzle located on the spray arm. Rotary cleaning is provided by supply of liquid under pressure to the apparatus causing rotation and distribution of fluid through the spray nozzle.

14 Claims, 3 Drawing Sheets

ROTARY CLEANING APPARATUS

This application claims the benefit of U.S. provisional application No. 60/281,540, filed Apr. 4, 2001.

TECHNICAL FIELD

The present invention relates in general to a system for cleaning the interior of a container. In particular, the invention relates to a system for cleaning the interior of containers associated with sewage pump or lift stations, e.g. wet wells, sump wells, sumps, collection tanks, holding tanks, and the like.

BACKGROUND OF THE INVENTION

Sewage systems are in universal use for removal of waste materials from individual dwellings, industrial premises, and municipalities. Waste materials are commonly carried by means of water flowing through pipes or conduits to sewage treatment plants. To maintain flow rate, sewage pumps are widely used. These pumps are electrically operated and are often automatically operated by use of float switches, proximity switches, probes, or the like. For example, when waste material/fluid in a wet well located at a sewage pump or lift station reaches a predetermined level, the pumps operate to empty the well. When waste material/fluid in the well falls to a second predetermined level, the pumps cease operation. Sewage contains various substances, such as waste, fats, greases, grit, and slime, which are capable of damaging the internal surfaces of, e.g., wet wells as well as the machinery located therein. As sewage levels decrease during pump operation, a residue of fats and other substances is left on the walls of the well between the high and low liquid levels. This residue, if allowed to accumulate, may damage machinery such as pumps, as well as causing damage to the walls of the well itself.

Another issue facing sewage treatment/storage systems is odor. It is not feasible to create a sewage treatment system in which sewage is constantly moving to its final destination. At certain points in all sewage treatment systems, sewage must be temporarily stored or accumulated prior to being moved to its next destination. Storage or retention of waste in holding tanks, wet wells, etc., even for a relatively short period of time, results in formation of significant odor, primarily due to hydrogen sulfide gases. Odors associated with sewage, such as from hydrogen sulfide, cause complaints in neighboring communities and municipalities, and may create a health hazard.

Accordingly, residue left by pumping operations in sewage pump or lift station facilities such as wet wells, sump wells, sumps, collection tanks, holding tanks, and the like must be removed. In many sewage systems, the process of cleaning this residue must be accomplished manually, requiring closed space entry into the well or tank by maintenance personnel. Due to odor, gas formation, slippery surfaces, and the like such closed space entry is at minimum unpleasant, and may pose a health hazard to personnel.

Accordingly, there is need in the art for cleaning systems capable of cleaning the interior of containers such as wet wells, holding tanks, and the like, to prevent the need for closed space entry into sewage holding facilities by humans. There is further need in the art for such cleaning systems which are also capable of ameliorating the odor associated with sewage holding containers during and between cleaning cycles.

SUMMARY OF THE INVENTION

The device of the present invention is a rotary cleaning apparatus for cleaning the interior of a container, for example a container associated with a sewage pump or lift station such as a wet well. In one aspect, this invention provides a rotary cleaning apparatus. The cleaning apparatus includes a support frame mounted to, a rotor assembly, at least one spray arm, at least one jet spray nozzle located on the spray arm, and at least one atomizing spray nozzle located on the spray arm. Motive force for the rotary cleaning apparatus is provided by a supply of liquid under pressure to the apparatus. In another aspect, the jet spray nozzle of the rotary cleaning apparatus may be adjusted to provide a desired rate of rotation. The supply of liquid to the rotary cleaning apparatus is controlled by means of a solenoid valve and a controller which regulate activation of the cleaning apparatus and duration of cleaning.

In another aspect of this invention, a specialized bracket is provided allowing mounting of the rotary cleaning apparatus on preexisting guide rails in the interior of the container. In yet another aspect, the present invention provides a chemical substance for reducing or ameliorating odor associated with sewage, and a means for introducing the desired chemical substance into the liquid used for cleaning. Atomizing spray nozzles located on the spray arms of the rotary cleaning apparatus allow dispersion of a fine mist of liquid containing the chemical substance for reducing or ameliorating odor. Accordingly, the odor-controlling chemical lingers between cleaning cycles, preventing build-up of odor at times when sewage is not actively being removed from the wet well or holding tank.

In still another aspect of this invention, a method of cleaning the interior of a container such as a wet well, sump well, sump, collection tank, holding tank, or the like is provided utilizing the rotary cleaning apparatus whereby cleaning begins only after the level of sewage contained in the container is lowered from a first preset level to a second preset level by, for example, a pump. The method of this invention also includes releasing a desired odor-controlling chemical into the interior of the container. The activation of the rotary cleaning apparatus and release of the desired chemical into the interior of the container is controlled by a controller, which opens a solenoid valve and allows liquid to flow to the apparatus only when sewage in the container reaches a predetermined low point and the pump cycle ends.

Additional advantages and other novel features of the invention will be set forth in part in the description that follows and in part will become apparent to those skilled in the art upon examination of the foregoing, or may be learned with the practice of the invention.

DETAILED DESCRIPTION OF THE INVENTION

In a preferred embodiment, the present invention comprises a rotary cleaning apparatus 10 for cleaning the interior of a sewerage wet well 14 containing standard pumps 16.

Figure 1:
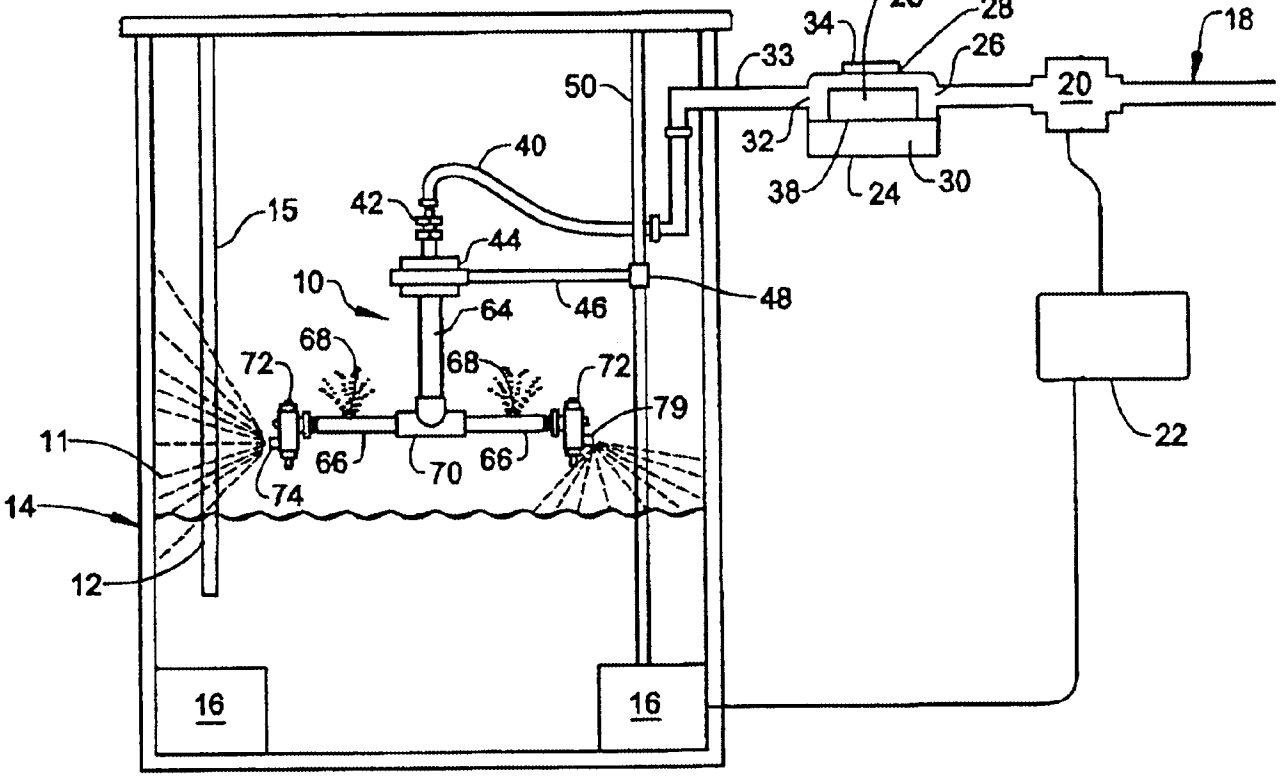
FIG. 1 is a cross-sectional view of the rotary cleaning apparatus positioned within a sewerage wet well.

The rotary cleaning apparatus 10 may be constructed of any suitable material, such as metal or plastic. In a presently preferred embodiment, the rotary cleaning apparatus 10 is constructed of stainless steel. Referring to FIG. 1, the apparatus 10 of the present invention requires a water source (not shown) supplying water to the apparatus 10 via a supply line 18. The water source may be any suitable source of water under sufficient pressure to provide adequate cleaning of the interior of a container such as a wet well. In a preferred embodiment, water for operation of the apparatus of this invention is provide by the main source of water to the sewerage wet well. As disclose in Australian Patent No. 655,111 to McCasker, in cases of limited or expensive water supply, water may also e provided to the apparatus 10 by means of a secondary submersible pump and filtration apparatus (not shown), which supplies filtered water drawn from sewage contained in the wet well 14 back into the supply line 18.

The supply of water to the cleaning apparatus 10 is regulated by a solenoid valve 20 under control of a controller 22. As will be described in greater detail below, the controller allows the apparatus 10 to operate to clean the interior of the wet well for a predetermined period of time, but only at the end of the pump cycle when sewage contained therein is at its lowest level and the maximum amount of surface area is exposed, thereby providing maximum cleaning with the minimum usage of water.

It is known that retention of sewerage, waste water, fats, and greases in sewerage wet wells results in the generation and accumulation of hydrogen sulfide gases ($H_2S$). The stench of $H_2S$ gases pose a nuisance and a health hazard, causing complaints from surrounding residential and commercial establishments and posing a danger to personnel involved in servicing equipment in or near wet wells. Accordingly, the present invention also provides a means for introducing a desired chemical substance (described in greater detail infra) into the water used to clean the interior of the wet well for the purpose of controlling or eliminating residual odor associated with sewage, particularly that caused by hydrogen sulfide gases.

Figure 2:
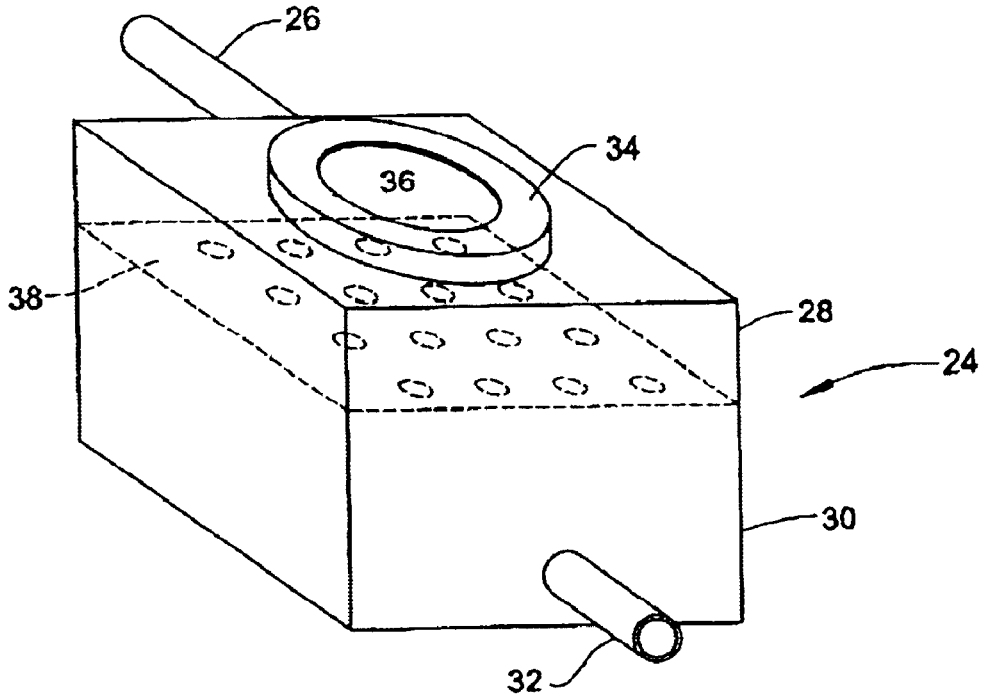
FIG. 2 is a transparent view of the positioning of a perforated partition within a chemical block housing.

In a preferred embodiment, the means for introducing a desired chemical substance comprises a specialized chemical block housing 24 situated downstream of the solenoid valve 20. The chemical block 25 which is placed in the chemical block housing 24 will be described in greater detail below. As best seen in FIG. 2, the chemical block housing 24 comprises an inlet 26 leading from the solenoid valve 20, a first chamber 28, a second chamber 30, and an outlet 32 feeding line 33 leading to the cleaning apparatus 10. The first chamber 28 may be provided with an access port 34, allowing access to the interior of the first chamber for insertion/replacement of the chemical block 25. In a preferred embodiment, the access port 34 is provided with a viewing port 36, allowing visual inspection of the chemical block without requiring opening access port 34. The first chamber 28 is separated from the second chamber 30, but remains in fluid connection with the second chamber. In a preferred embodiment, the first chamber is separated from the second chamber by a perforated partition 38.

It can therefore be appreciated that the chemical block housing 24 allows introduction of a desired chemical substance into the water used to wash the interior of a desired container. Water from the supply line 18 enters into the first chamber 28 and mixes with the chemical block containing the desired chemical(s). The chemical block 25 is specially formulated to release a desired amount of these chemicals into the flowing water passing over and around the block, then through the perforated flooring 38 into the second chamber 30, and on to the cleaning apparatus 10 through outlet 32 and line 33.

Referring to FIG. 1, the line 33 feeds the water and treatment chemicals to a flexible line 40 that directly supplies the cleaning apparatus 10. Any suitable line may be used, such as a reticulated hose. Flexible line 40 connects to an inlet 42 in a rotary hub 44. The rotary hub 44 is supported by a support arm 46 proximately mounted thereto. Said support arm 46 is mounted at its distal end to an interior wall of the sewerage wet well 14 by a bracket 48. The support arm 46 may be of fixed length, or may be telescopic to allow support of the cleaning apparatus 10 at any desired distance from an interior wall of the sewerage wet well 14.

The support arm 46 may be affixed directly at the desired position to an interior wall of the sewerage wet well 14 by any suitable means, such as a bolt. In one embodiment, as disclosed in Australian Patent No. 655,111, the support arm 46 is pivotally mounted to a mounting plate for movement in a vertical plane. As it will be appreciated, it is thus possible to swing the cleaning apparatus 10 upward to allow access to and/or entry into the interior of the sewerage wet well for, e.g., maintenance or replacement of pumps 16.

In a preferred embodiment of this invention, the support arm 46 is mounted using specialized brackets 48 to pre-existing guide rails 50 extending substantially along the vertical axis of the sewerage wet well 14 (FIG. 1). It is known to utilize guide rails for lowering pumps 16 into place in sewerage wet wells. These same guide rails may be utilized when it is necessary to remove pumps 16 for maintenance or, more commonly, replacement. Use of both single and paired guide rails 50 for placement of pumps 16 is known. The present invention includes a specialized support bracket 48 for mounting the support arm 46 to a desired height on pre-existing guide rails 50. Depending on the number of guide rails available, the support bracket 48 may be configured to affix the cleaning apparatus 10 to a pair of guide rails (FIG. 3*a*) or to a single guide rail (FIG. 3*b*). Preferably, the support bracket 48 is affixed to said guide rails 50 to maintain the cleaning apparatus 10 at least 1 to 1.5 meters above the highest sewage level anticipated, thereby preventing insertion of the cleaning apparatus 10 directly into the sewage.

Figure 3A:
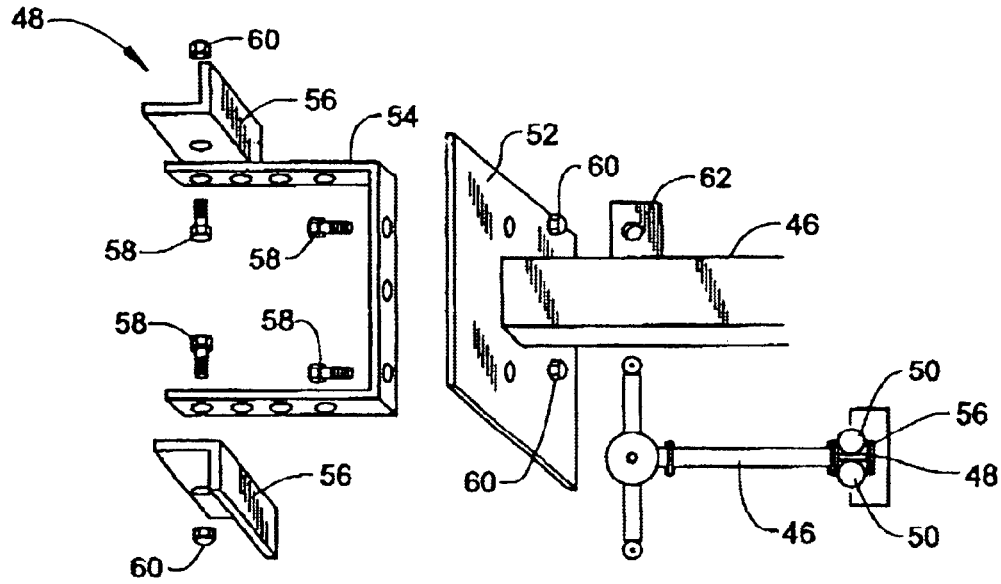
FIG. 3A is an exploded view of a support bracket configuration for a pair of guide rails.
Figure 3B:
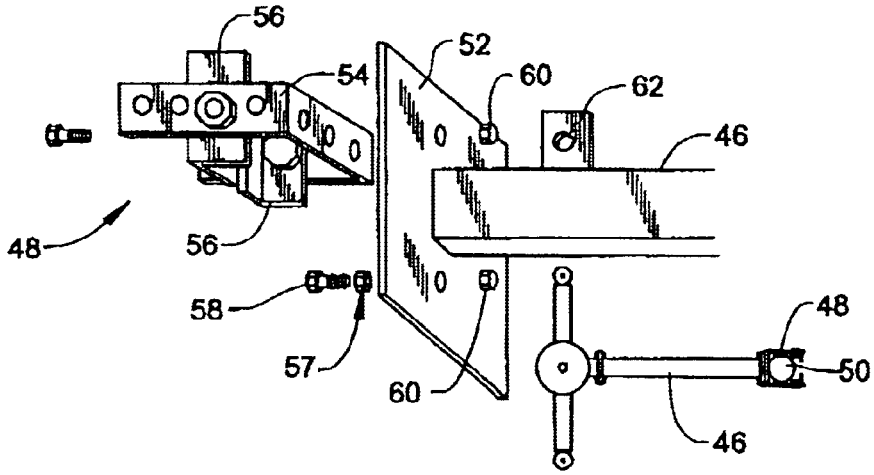
FIG. 3B is an exploded view of a support bracket configuration for a single guide rail.

As best seen in FIG. 3*a*, support arm 46 terminates distally in a flat base plate 52. Support arm 46 further includes a tab 62 which provides an attachment point for a means for raising/lowering the support arm 46 and the cleaning apparatus 10. Any suitable means for raising/lowering the cleaning apparatus may be employed, e.g. a rope, chain, or cable (not shown). The support bracket 48 comprises a U-shaped member 54 containing apertures therethrough for cooperatively engaging similarly placed apertures in the flat mounting plate 52. The U-shaped member 54 further contains a plurality of apertures for cooperatively engaging at least two L-shaped retention pieces 56 at different positions along the U-shaped member. As will be described below and illustrated in FIGS. 3*a* and 3*b*, the support bracket 48 may be adapted to capture a single guide rail or a pair of guide rails, depending upon the positioning of L-shaped retention pieces 56.

When it is desirable to affix the support bracket 48 to a pair of guide rails, the U-shaped member is centrally affixed to base plate 52 using bolts 58 and nuts 60. Two L-shaped retention pieces 56 are mounted to the exterior surface of U-shaped member 54 so that the L-shaped retention pieces extend perpendicularly to the direction of the U-shaped member (as shown in FIG. 3*a*) and affixed thereto with bolts 58 and nuts 60. Accordingly, each guide rail 50 is captured between the L-shaped retention pieces 56 and the guide rails 50 to which the support bracket 48 is to be mounted.

When the support bracket 48 is to be used to mount the support arm 46 to a single guide rail, two L-shaped retention pieces 56 are mounted to the interior surface of U-shaped member 54 so that the L-shaped retention pieces extend perpendicularly to the direction of the U-shaped member (as shown in FIG. 3*b*) and affixed thereto with bolts 58 and nuts 60. Accordingly, each guide rail is captured between the L-shaped retention pieces 56 and the U-shaped member 54. The specific location at which the L-shaped retention pieces 56 are affixed to the U-shaped member 54 is determined by the diameter of the guide rail 50 to which the support bracket 48 is to be mounted. In this configuration, the base plate 52 and support arm 46 extending therefrom are maintained in an essentially horizontal configuration using a bolt 58 affixed to the base plate 52, with a spacer nut 57 to provide a suitable spacing between the base plate 52 and the corresponding surface of the guide rail 50.

As described in Australian Patent No. 655,111, the cleaning apparatus 10 comprises a rotary hub 44 mounted at the proximal end of the support arm 46, said rotary hub 44 having a fluid inlet fitting 42 for receiving the flexible line 40. The cleaning apparatus further comprises a hollow rotary shaft 64 rotatably attached to the rotary hub 44 and extending therefrom in a direction substantially parallel to the vertical axis of the sewerage wet well 14. The hollow rotary shaft 64 terminates distally in a hollow fitting 70 for attaching a plurality of hollow spray arms 66 extending radially therefrom. For example, in one embodiment shown in FIG. 1, the hollow rotary shaft 64 terminates in a standard T-fitting, to which two hollow spray arms 66 are attached.

The hollow spray arms 66 include atomizing spray nozzles 68, oriented to spray a fine curtain of mist in an upward direction. As will be described in more detail below, the atomizing spray nozzles 68, in conjunction with chemical released into the liquid supply by the chemical block 25, allows dispersion of water/chemical as a curtain of fine mist to reduce or eliminate odor associated with $H_2S$ and other gases which accumulate when sewage is stored for prolonged periods of time. The atomizing spray nozzles 68 may be placed at any desired location along the upper surface of spray arms 66, e.g. proximal to the hollow fitting 70, centrally located along the hollow spray arms 66, or at the distal end of the spray arms 66.

Each hollow spray arm 66 terminates in a spray nozzle housing 72 which allows application of liquid under pressure to the interior walls of the sewerage wet well 14. The jet spray nozzles 74 are oppositely inclined in plan view to provide a rotational driving force for the cleaning apparatus 10. The jet spray nozzles 72 are adjustable in several ways. First, the angle of spray of each jet spray nozzle may be adjusted to aim cleaning liquid at a different area of the interior of the sewerage wet well 14. For example, one jet spray nozzle 74 may be aimed at the surface of the sewage, while the other jet spray nozzle 74 may be aimed at the fat line left after sewage is pumped out of the wet well, allowing cleaning of the wall of the wet well while simultaneously flushing fat, sewage, grit, and the like from the bottom of the wet well. It should be appreciated that any of a number of jet spray nozzles 74 providing varying spray patterns and spray strengths may be incorporated into the spray nozzle housing 72, depending upon the level of cleaning required for the particular wet well. For example, a wet well which tends to be lower in fat or which receives limited use may require only light cleaning. However, a wet well with a particularly fatty deposit, or one which receives heavy usage, may require significantly more cleaning. Different spray nozzles 74 providing a lighter or a heavier spray pattern, as desired, may therefore be incorporated into the spray nozzle housing for increased or decreased cleaning.

Figure 4:
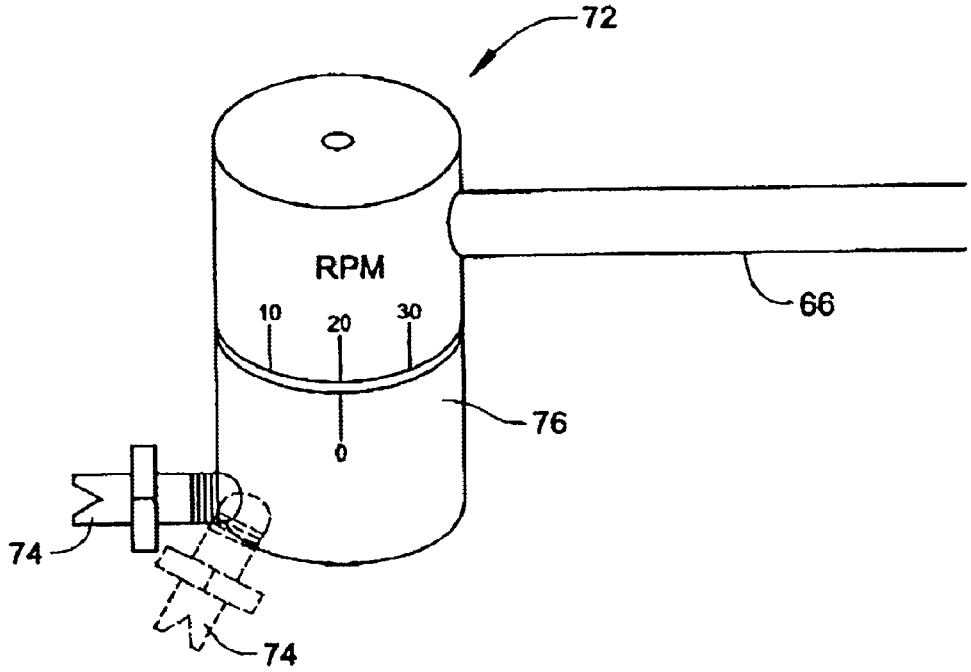
FIG. 4 is a perspective view of a spray arm/jet spray nozzle housing/jet spray nozzle construction.

Second, the jet spray nozzle assemblies 72 may be adjusted to alter the pressure of water emanating therefrom, thereby providing a means for adjusting the speed of rotation of the cleaning apparatus 10. As best seen in FIG. 4, the spray nozzle housing 72 includes a dial 76 which may be adjusted to compensate for varying water pressure supplied to the cleaning apparatus 10 from the main water source. By turning the dial 76 to the desired setting as determined by the water pressure being supplied to the cleaning apparatus 10, a specific rate of rotation may be achieved. As will be described in more detail below, in conjunction with use of the controller 22 of this invention, it is therefore possible to apply a predetermined amount of water to the interior surface of the wet well 14 at each cleaning cycle, thereby resulting in the maximum possible cleaning while achieving a substantial savings in the amount of water used.

The chemical composition utilized in the present invention is preferably in the form of a gel block. That gel block comprises by weight percent 0.6–1.0% gellan gum, 0.15–0.025% xantham gum, 0.1–0.2% calcium sulfate, 20.–50.0% propylene glycol, 45–70% fragrance and the remainder is water. The fragrance may be any fragrance useful in masking or eliminating odor from hydrogen sulfide and other gases associated with storage of sewage.

The gel block is made by dissolving appropriate amounts of gellan gum and xantham gum in a mixture of water and glycol. The mixture of water, glycol and dissolved gums is heated to 80–90° C. to minimize viscosity and permit easier processing. The mixture is held at that elevated temperature for about 15 minutes. An appropriate amount of $Ca50_{4—2}H_2$ (calcium sulfate) and preservative are then added to the mixture which is then mixed and cooled to 50–70° C. Next, appropriate amount of fragrance is added and the solution is mixed thoroughly. The thoroughly mixed solution is then poured into appropriate containers to provide a gel block of desired shape upon cooling to room temperature.

The gel block is formulated to release a desired amount of chemical as water at ambient temperature flows over and around the gel block at a rate of between about 30 and 150 CPI. This insures that the proper amount of chemical is delivered to the well 14 through the atomizing nozzles 68 and jet spray nozzles 74 to provide effective deodorizing and cleaning of the well wall.

Reference is now made to use of a presently preferred embodiment of the present invention as shown in FIG. 1. It is known to use pumps to drain sewage from the interior of sewerage wet wells. In a typical system, sewage accumulates in a wet well 14 until the liquid level 13 reaches a first switch 11 or "duty" level on a probe 15. At that time, the pumps 16 are activated and sewage is pumped out of the well 14 until the liquid level 13 of sewage reaches a second switch 12 or "stop" level on the probe 15. Prior art automatic cleaning systems are often designed to operate concurrently with the operation of the pumps. For example, the cleaning system would operate to wash the interior of the wet well as sewage was still being pumped out of the well. Disadvantageously, this system results in the cleaning system operating without the maximum about of interior wall of the wet well being exposed.

The present invention circumvents this problem by use of a specialized controller 22 which controls opening and closing of the solenoid valve 20. The controller 22 of this invention, in conjunction with the solenoid valve 20, activates the cleaning apparatus 10 only at or near at the end of the pump cycle, rather than the beginning or the middle of the cycle. The first step of the process as embodied in this invention is to program the controller 22 with a predetermined schedule for washing the interior of the wet well. Next is activation of the pumps 16 to pump sewage out of the wet well 14. Activation of the pumps 16 also provides a first signal to the controller 22. As the time for the predetermined scheduled wash cycle arrives and the pumps 16 reach the end of the pumping cycle immediately prior to the preprogrammed wash cycle, the controller 22 receives a second signal, i.e. signaling the end of the pump cycle. Upon reaching the end of the pump cycle, controller 22 sends a third signal to open solenoid valve 20, allowing water to flow into the chemical block housing 24 and therethrough on to the cleaning apparatus device 10, providing cleaning/deodorizing of the interior of the wet well. This system advantageously allows the cleaning apparatus 10 to be programmed to clean only when the sewage level in the wet well 14 is at its lowest and the maximum amount of wall space is exposed.

It should be appreciated that the controller 22 of this invention may be used to activate the cleaning apparatus 10 at any desired preset interval. Accordingly, depending on the level of cleaning required by the particular wet well, the controller may only activate the rotary cleaning apparatus 10 of this invention, e.g., after every third pump cycle, fifth pump cycle, and so on. The controller 22 also determines the length of time that the cleaning apparatus 10 will be actively cleaning. It may therefore be appreciated that, in conjunction with the specific spray nozzle 74 and the setting of dial 76, use of the controller 22 to run the cleaning apparatus 10 for a predetermined period of time, but only after sewage has been pumped out of the well, allows specific tailoring of the amount of water used to the specific wet well, thereby resulting in not only significantly more efficient cleaning, but a significant cost savings due to the reduced amount of water used.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, a simple electronic unit could be provided to initiate timed operation of the cleaning apparatus 10 in response to the pumps 16 shutting off at the end of the pumping cycle. Still another alternative could be the provision of a simple electronic circuit and level sensor arrangement that initiates timed operation of the cleaning apparatus when the level of sewage in the wet well is at or near the stop level.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention when interpreted in accordance with the breadth to which it is fairly, legally, and equitably entitled.

What is claimed is:

1. In an sewage container active to receive a first liquid, said sewage container having at least one pump therein, wherein said at least one pump cooperates with a first switch to discharge said first liquid from said sewage container when said first liquid reaches a predetermined upper level and wherein said at least one pump cooperates with a second switch to cease discharging said first liquid from said sewage container when said first liquid reaches a second predetermined lower level, an apparatus for cleaning an interior of said sewage container comprising:

a support frame;

a rotor assembly mounted on the support frame rotatable about an axis;

at least one spray jet nozzle mounted on said rotor assembly;

at least one atomizing spray nozzle mounted on said rotor assembly;

a conduit for directing a second liquid under pressure from a second liquid supply to said at least one spray jet nozzle and said at least one atomizing spray nozzle;

a chemical supply assembly for introducing a desired chemical substance into said second liquid; and a controller, wherein said controller is constructed and arranged to cycle said cleaning apparatus to release said second liquid under pressure into said interior of said container for a predetermined period of time after said first liquid has been discharged to about said second lower level.

2. The apparatus of claim 1, wherein the support frame includes at least one support arm mounted on the wall of said sewage container and supported by a bracket assembly attachable to pre-existing guide rails in said container.

3. The apparatus of claim 2, wherein the support arm is telescopic.

4. The apparatus of claim 2, wherein said bracket assembly is adapted for attachment to a single guide rail extending substantially along the vertical axis of the container.

5. The apparatus of claim 2, wherein said bracket assembly is adapted for attachment to a pair of guide rails extending substantially along vertical axis of the container.

6. The apparatus of claim 1, wherein the rotor assembly comprises;

a rotary hub mounted on the distal end of the support arm, the rotary hub having an inlet connectable to a pressurized second liquid supply line and an outlet;

a tubular rotary shaft sealably attached to the rotary hub;

a plurality of spray arms radiating from the tubular rotary shaft;

a plurality of said at least one spray jet nozzle provided adjacent to the distal ends of the spray arms; and a plurality of said at least one atomizing spray nozzle provided on said spray arms.

7. The apparatus of claim 1, wherein said second liquid under pressure exiting said at least one spray jet nozzle provides force to rotate the rotor assembly.

8. The apparatus of claim 7, wherein said at least one spray jet nozzle may be adjusted to provide a desired rate of rotation.

9. The apparatus of claim 1, wherein said chemical supply assembly includes a source of chemicals held in a chemical supply housing.

10. The apparatus of claim 9, wherein said chemical supply housing comprises:

an interior compartment;

a partition dividing said compartment into a first chamber and a second chamber in fluid communication through said partition with said first chamber, said source of chemicals being held in at least one of said chambers;

an inlet in fluid communication with a pressurized liquid supply line and said first chamber; and an outlet in fluid communication with said second chamber and said conduit.

11. The apparatus of claim 1, wherein said controller includes a timing device and at least one solenoid valve controlled by said timing device.

12. The apparatus of claim 1, wherein said controller is constructed and arranged to monitor operation of said at least one pump, wherein said controller ceases operation of said cleaning apparatus during operation of said at least one pump.

13. The apparatus of claim 1, including a secondary pump for supplying said first liquid from within said sewage container to said cleaning apparatus during operation thereof, said pump having an inlet for intake of said first liquid and an exhaust for discharge of said first liquid.

14. The apparatus of claim 13, including a filter, wherein said filter is in fluid communication with said first liquid and said pump intake, wherein said filter at least partially prevents solids from entering said secondary pump.

* * * * *